US005797768A

United States Patent [19]

Francaviglia

[11] Patent Number: 5,797,768

[45] Date of Patent: Aug. 25, 1998

[54] ELECTRICAL CONNECTOR AND SYSTEM FOR AUTOMATIC INSERTION MACHINERY

[75] Inventor: Joe Francaviglia, Bloomingdale, Ill.

[73] Assignee: Senior Industries, Inc., Wood Dale, Ill.

[21] Appl. No.: 693,931

[22] Filed: Aug. 5, 1996

[51] Int. Cl.[6] ..... H01R 13/66

[52] U.S. Cl. ..... 439/567

[58] Field of Search ..... 439/567, 571, 439/572

[56] References Cited

U.S. PATENT DOCUMENTS

| | | | |
|---|---|---|---|
| 4,588,854 | 5/1986 | Bailey et al. | 439/567 |
| 5,401,187 | 3/1995 | Ortega | 439/567 |

*Primary Examiner*—Khiem Nguyen
*Assistant Examiner*—Eugene G. Byrd
*Attorney, Agent, or Firm*—Ronald L. Wanke; Jenner & Block

[57] ABSTRACT

An electrical connector such as a miniature power jack contains a single snap-fit post for connection to a printed circuit board. A plurality of alignment posts and electrical terminals also extend from the bottom of a housing. The snap fit post is located off-center in an asymmetrical arrangement and is located closer to an access opening which receives an external plug which is removably insertable over a cylindrical pin connected to one of the terminals. A spring forms a make and break electrical power jack. The snap fit post has an enlarged head with tapered end surfaces and canted shoulders located intermediate between the tapered surfaces and the housing to form a snug interference fit with the printed circuit board aperture. The electrical connectors can be located within specially designed pockets provided on a carrier tape for automatic insertion machinery. Each carrier pocket includes a recessed floor for holding the snap-fit connector such that the top surface of the connector is substantially flush with the top surface of the carrier tape.

16 Claims, 3 Drawing Sheets

ELECTRICAL CONNECTOR AND SYSTEM FOR AUTOMATIC INSERTION MACHINERY

The present invention relates to an electrical connector having a snap fit connection for retention by a printed circuit board, and a carrier tape for conveying the electrical connector to automatic insertion machinery. The invention is particularly adaptable to miniature electrical connectors such as a power jack.

BACKGROUND OF THE INVENTION

Electrical connectors, such as a power jack, are placed on printed circuit boards by automatic insertion machinery. Prior to wave soldering of the electrical connector to the printed circuit board, it is necessary that the electrical connector form a secure fit with the printed circuit board. Furthermore, certain electrical connectors can be inserted or conveyed upside down and hang from the printed circuit board before wave soldering. It is necessary that such electrical connectors be securely maintained in a precise alignment with the printed circuit board, even when hanging upside down.

The problem of designing an electrical connector which can be easily inserted and securely held in a printed circuit board is particularly acute for miniature connectors which have minimal surface area such as dimensions of several millimeters. It is desired that the insertion force should be low, yet the connector must be securely fitted to the printed circuit board even when hanging upside down. It has been known to include spaced snap fit posts at opposite ends of electrical components, but this design is difficult to implement in a miniature electrical component. The various protrusions which extend from the electrical connector to the printed circuit board should be spaced apart as much as possible to prevent the apertures in the printed circuit board from being spaced too closely together which would weaken the printed circuit board. A secure mechanical connection to the printed circuit board is desirable, particularly for connectors which repeatedly receive insertion and removable forces as an external connector is plugged into the connector mounted to the printed circuit board, but this is difficult to obtain in a miniature power jack or other miniature electrical connector.

For use with automatic insertion machinery, it is desirable that the electrical connector be readily carried in the pockets of a carrier tape and be easily removed by a conventional suction head for placement on the printed circuit board. These requirements are difficult to obtain for electrical connectors having protrusions of varying lengths. Thus, it is desirable to provide a miniature electrical connector which can be readily removed from carrier tape for an automatic insertion machine, can be easily inserted and retained in a printed circuit board even when located upside down, and which will provide superior mechanical connection without any undue weakening of the printed circuit board due to the location and spacing of aperture holes which receive protrusions from the electrical connector.

SUMMARY OF THE INVENTION

In accordance with the present invention, an electrical connector is provided which is readily adapted to miniature size and which provides a superior mechanism for securing to a printed circuit board. Furthermore, the invention is adaptable to automatic insertion machinery in which carrier tape has particular requirements as to orientation, ease of removal and other requirements.

An object of the present invention is to provide an improved electrical connector which provides a snap fit connection to a printed circuit board. A secure mechanical connection is formed without undue weakening of the printed circuit board and the design is compatible with the use of standard automatic insertion machinery.

It is a further object of the present invention to provide an automatic insertion system in which a carrier tape of special configuration will convey an improved electrical connector to standard automatic insertion machinery for insertion onto a printed circuit board. The electrical connector is particularly adaptable to miniaturization and provides various electrical and mechanical protrusions which can be subject to repetitive stresses once mounted on the printed circuit board.

Other and additional advantages of the invention will be apparent from the description and the drawings.

DETAILED DESCRIPTION OF THE INVENTION

Figure 1:
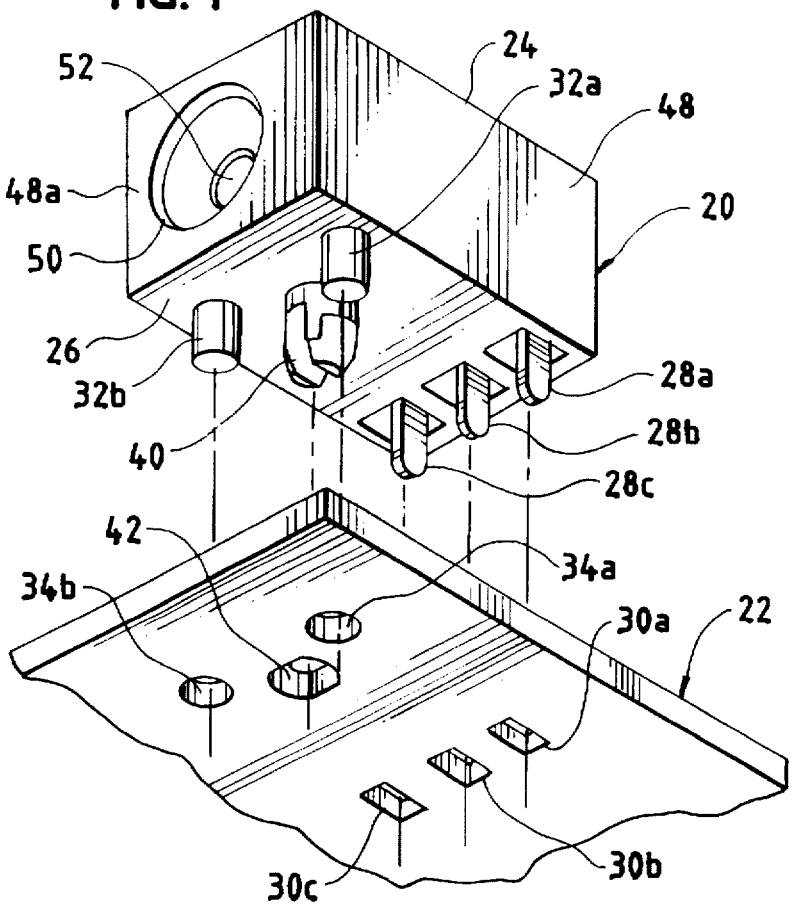
FIG. 1 is a perspective view of an electrical connector according to the present invention and a portion of a printed circuit board which receives the electrical connector.

As best shown in FIG. 1, an electrical connector 20 such as a miniature power jack is designed to be inserted onto a printed circuit board 22. The electrical connector 20 includes a housing 24 containing a bottom mounting surface 26 which is to engage the surface of the printed circuit board 22. A plurality of mechanical and electrical extensions extend from the bottom mounting surface and into corresponding apertures in the printed circuit board 22, and/or onto mounting pads on the surface of the printed circuit board, for electrical and mechanical connection to the board. A plurality of electrical terminals 28, labeled 28*a*, 28*b* and 28*c*, extend outwardly from the mounting surface 26 and into corresponding apertures 30*a*, 30*b* and 30*c* in the printed circuit board 22. As is conventional, the printed circuit board has electrical leads (not illustrated) located on either the top surface and/or lower surface of the board for contact with the electrical terminals 28. After the electrical component 20 is inserted onto the board 22, the terminals are soldered to the board by conventional techniques such as reflow or wave soldering.

Also extending from the bottom mounting surface 26 are several mechanical protrusions which serve to align and hold the component 20 to the printed circuit board. A pair of corresponding alignment posts, 32*a* and 32*b*, extend downwardly from the mounting surface 26 and into a pair of alignment apertures 34*a*, 34*b* located in the printed circuit board 22. A single snap fit post 40, located intermediate the alignment posts 32 and terminals 28, as will be explained, extends from an off-center position on the mounting surface 26 and into a corresponding aperture 42 located on the printed circuit board 22. The snap fit post 40 will firmly hold the electrical connector 20 to the printed circuit board 22 upon insertion and during the wave soldering operation, as well as later as an external electrical plug is repeatedly connected and disconnected from the connector 20. The design of the electrical connector 20 including the snap-fit post 40 is such as to provide a secure connection even when the connector 20 is located upside down (not illustrated) on the bottom side of the printed circuit board 22 and/or while the printed circuit board 22 is conveyed upside down by automatic insertion and assembly machinery during the wave soldering and assembly operations. While the apertures 30 and 42 in the printed circuit board 22 are shown of a shape to fit the corresponding protrusions from the connector 20, it will be understood that the apertures may be round holes which are easier to form in a printed circuit board, so long as aperture 42 is dimensioned to provide a proper interference fit for snap post 40.

Figure 2:
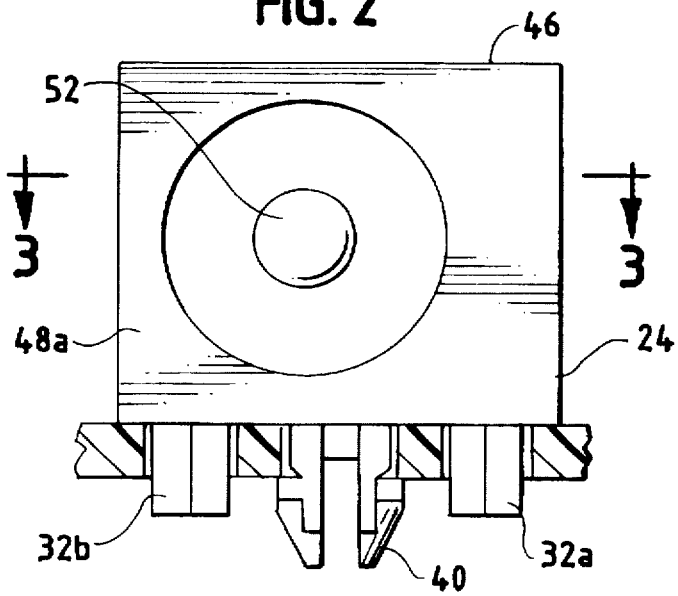
FIG. 2 is a front view of the electrical connector and printed circuit board shown in FIG. 1.
Figure 4:
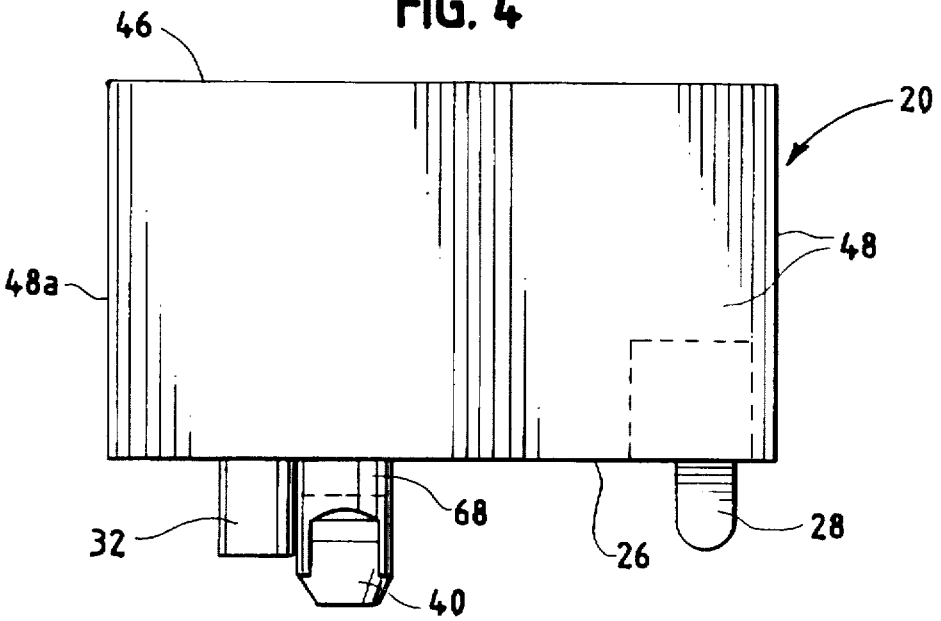
FIG. 4 is a side view of the electrical connector.

As seen best in FIGS. 1, 2 and 4, the housing 24 includes a flat top surface 46 which is parallel to the bottom mounting surface 26. The flat surface 46 is smooth and designed to be picked up and transported by a vacuum head of the automatic insertion machinery. A plurality of side walls 48 connect the top and bottom surfaces 46 and 26 so as to provide an enclosure for the power jack. The housing 24 may be molded of plastic and should be formed of a grade of plastic material which can withstand a reflow solder temperature such as 240° C. without deformation. Particularly, the snap fit post 40 should not unduly expand or distort when exposed to such temperatures.

Figure 3:
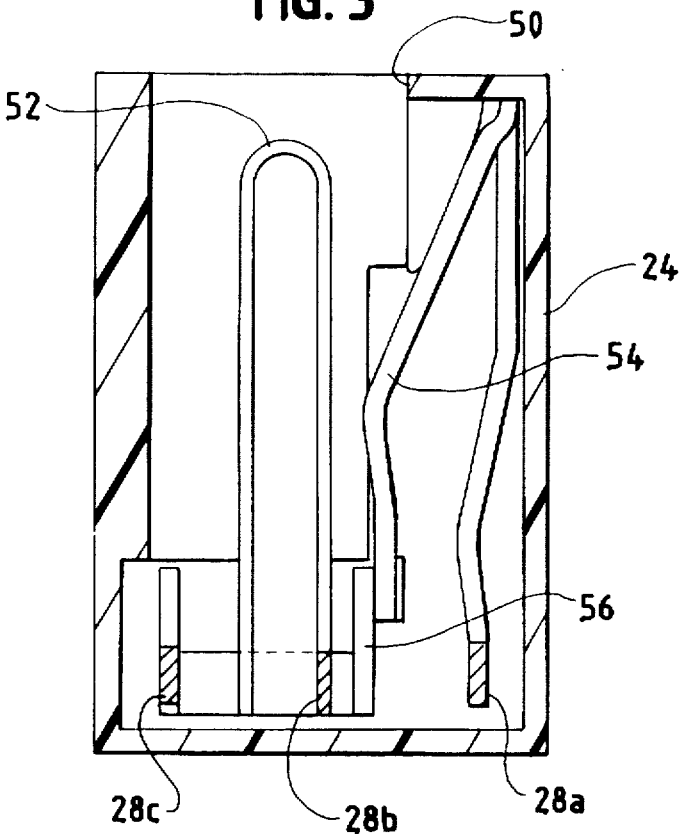
FIG. 3 is a cross-sectional view taken along lines 3—3 of FIG. 2 and showing the electrical connector.

One of the housing side walls, labeled 48*a*, contains an access aperture 50 which exposes a male cylindrical pin 52, see FIG. 3, which is electrically connected to the middle terminal 28*b*. The pin may be formed of brass which is silver plated. As best seen in FIG. 3, the housing 24 contains a leaf spring 54 which is electrically connected to the terminal 28*a*. The movable opposite end of the sleeve spring has a pair of dimples which bears against a shunt sleeve contact point 56 which is electrically connected to the terminal 28*c*. In an illustrative embodiment, the power jack can be used to connect 12 volt DC power from an external source (not shown) to the printed circuit board 22. A convention female plug (not illustrated) is inserted through the access opening 50 and over the pin 52. The plug will push the movable end of the spring 54 away from the shunt contact 56 and break the electrical contact between terminals 28*a* and 28*c*. This may be used, for example, to disconnect an internal battery source when an external power source is to be connected to the printed circuit board. The pin 52 and the shunt may be formed of brass material which is silver plated. The sleeve spring 54 may be formed of phosphor bronze which is silver plated. While a three terminal power jack has been illustrated, it will be understood that the electrical connector could be formed with two terminals and the make and break connection could be eliminated.

The leads 28 are illustrated as straight flat sections which extend through holes in the printed circuit board and are soldered on the rear side of the board. For some boards, however, a surface mount is desirable and the leads 28 may be bent in an L-shape or be formed by pads which are flush mounted to the top surface of the printed circuit board. The connector 20 is thus adaptable to surface mount as well as through-the-hole versions.

Figure 5:
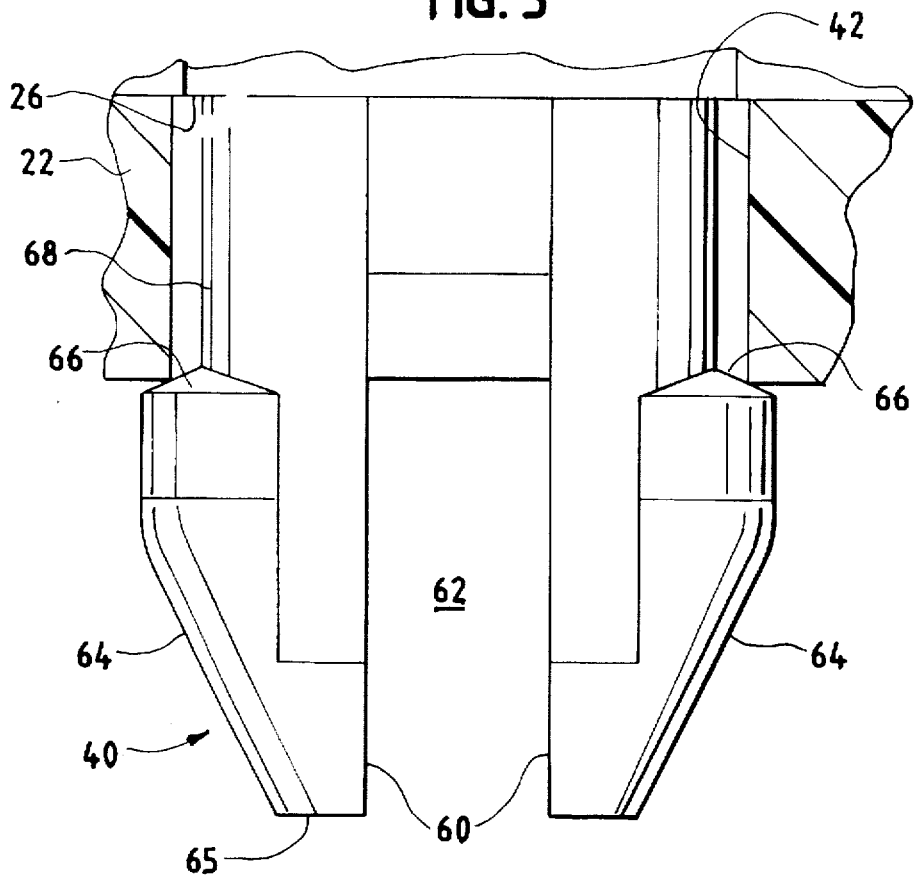
FIG. 5 is an enlarged view of the snap fit post of the electrical connector and adjacent printed circuit board seen in FIG. 2.

The details of the snap-fit post 40 are best seen in FIG. 5. An enlarged snap-fit head is formed by a pair of resilient fingers 60 located on each side of a center slot 62. Resilient fingers 60 each have a tapered outer wall 64 which tapers to an end 65 having a diameter less than the diameter of the hole 42 in the printed circuit board. As the connector 20 is inserted against the printed circuit board, the tapered sections 64 compress inwardly towards the slot 62 and allow the enlarged head to pass through the printed circuit board 22 and snap outwardly for retention. The enlarged head opposite the end 65 tapers inward and has canted shoulders 66 which extend to a neck section 68 to connect the enlarged head with the bottom mounting surface 26 of the connector. After insertion through the printed circuit board, the shoulders 68 form a cam surface which snugly fits against the edge of the aperture 42 to create an interference fit. As a result, the snap fit post 40 securely captures and holds the connector 20 in position, even when the connector 20 is upside down and hanging below the printed circuit board. Furthermore, the skewed shoulders 66 form a cam seating surface which minimizes the effects of slight variations in the aperture size due to manufacturing and/or tolerance variations.

As seen best in FIGS. 1 and 4, the single snap-fit post 40 is preferably off-center and located closer to the access side wall 48*a*. As a result, the post 40 is asymmetrically located on the bottom of the connector and is closer to the alignment post 32 than the terminals 28. This position is desirable because the external plug (not illustrated) which is insertable over the pin 52 will tend to lift and stress the connector more in the vicinity of the access wall 48*a*. Thus, the snap-fit post is preferably located nearer the access opening 48*a*. The access opening in turn will typically be located near the edge of the printed circuit board to allow easy access to the connector 20.

The electrical connector as illustrated is particularly suitable for use with a miniature connector in which the area of the bottom mounting surface 26 is very small. For example, the width of the front of the connector as seen in FIG. 2 may be 6 millimeters and the side length of the connector, as seen in FIG. 4, may be 9 millimeters. The height of the connector from the bottom surface 26 to the top surface 46 may be on the order of 5 millimeters. Use of a single snap-fit post 40, rather than separated posts, is important in a miniature connector of such small dimensions. Also, a single snap-fit post minimizes the number of holes or apertures to be formed in the printed circuit board and which would weaken the board.

In order to form a snap-fit connection, it is necessary that the enlarged head protrude below the printed circuit board after insertion, as seen in FIGS. 2 and 5. However, it is not necessary nor desirable that the other protrusions from the connector 20, such as the terminal leads 28 or the alignment posts 32 should extend this distance. Generally, these protrusions are designed to extend flush with or slightly below the bottom surface of the board, as seen in FIG. 2. The bottoms of the alignment posts 32 and the terminals 28 form a plane which is generally parallel to the plane of the bottom mounting surface 26. Because snap fit post 40 extends through and beyond this plane, the connector 20 would not sit flat on its bottom protrusions, but would tilt or cant to one side. This can present difficulties for standard automatic insertion machinery, and to overcome these difficulties, the carrier tape system shown in FIGS. 6 and 7 may be utilized so that the connector 20 can be inserted in printed circuit boards by conventional automatic insertion machinery.

Figure 6:
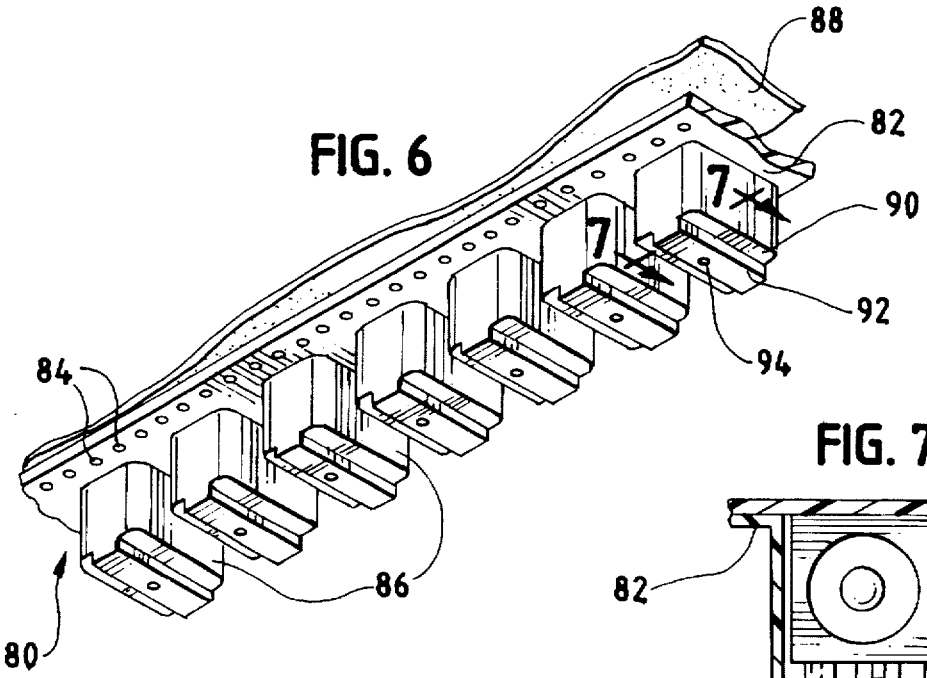
FIG. 6 is a perspective view of a portion of a carrier tape for automatic insertion machinery including a plurality of pockets which contain the electrical connectors of the present invention.
Figure 7:
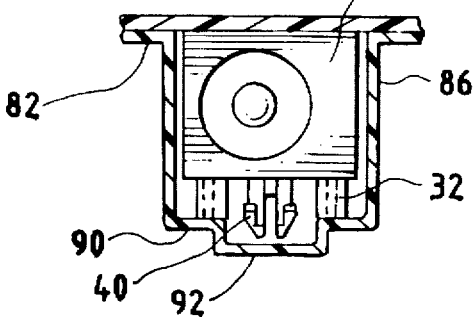
FIG. 7 is a cross-sectional view taken along lines 7—7 of FIG. 6 and showing one pocket of the carrier tape and the electrical connector located therein.

As seen in FIGS. 6 and 7, a carrier tape 80 for automatic insertion machinery contains an upper feed surface 82 with a plurality of sprocket holes 84 located along the edge of the feed surface. A plurality of pockets 86 are formed within the carrier tape to hold electrical components to be mounted to the printed circuit board. The top of each pocket 86 is open so that conventional insertion machinery (not illustrated) can extend a vacuum head against the top of the component and transfer it to a position in which the component is inserted into the printed circuit board. A carrier film 88 is releasably fastened to the carrier tape by a standard fastening technique such as heat, adhesion or another standard manner to temporarily hold the components within the pockets of the carrier tape until they are to be unloaded and inserted into the printed circuit board. The automatic insertion machinery then peels or strips the film 88 from the feed surface 82 in order to expose the components within the pockets 68 to the vacuum head for insertion onto the printed circuit board. The operation of the automatic insertion machinery and the carrier tape 80 as generally described above is convention, and may take a variety of standard forms.

In accordance with the present invention, however, the carrier tape pockets 86 are formed in a unique manner so that the electrical connectors 20 in accordance with the present invention can be utilized with conventional automatic insertion machinery. More particularly, each pocket 86 contains a bottom supporting surface 90 for supporting the alignment posts 32 and the terminals 28. A recessed bottom supporting surface 92 is located at a greater depth than the supporting surface 90 as measured from the top feed surface 82 in order to form a longitudinal cavity or recess along the bottom floor of the pocket. The snap-fit post 40 extends against or slightly above this recess supporting surface 92 to prevent the connector from being cocked when placed within the pocket 86. As a result, the smooth top surface 46 of the connector 20 is flush with the plane of the top feed surface 82 so that a conventional vacuum head can be placed against the flat top surface 46 to remove the connector from the carrier pocket.

An air hole 94 is located through the recessed supporting surface 92 to vent the pocket 86 so as to prevent any partial vacuum as the vacuum pick-up head of the automatic insertion machinery lifts the connector out of the pocket. While the recessed surface 92 could be a cylindrical recess under the single snap fit post 40, it preferably extends along the entire longitudinal length of the floor of the pocket 86 because the post is off-center and asymmetrical on the connector. As a result, the connectors 20 can be flipped 180° within the pockets but the snap fit posts will still be located within the recess area 92, providing more flexibility in loading of the components to be inserted onto the printed circuit board.

Numerous variations can be made without departing from the invention. For example, while a pair of alignment posts 32 have been illustrated, it will be apparent that a single alignment post could be utilized, or the alignment post could be eliminated in less critical situations. Other variations in the invention will be apparent to one skilled in the art.

I claim:

1. An electrical connector mountable on a first surface of a printed circuit board having a mounting aperture extending through the board to a second surface, comprising:

an electrical contact for connection to an external electrical source;

a housing containing the electrical contact and including a mounting surface for mating engagement with the first surface of the printed circuit board;

a terminal extending from the mounting surface and electrically connected to the contact; and a snap fit post for insertion into the mounting aperture of the printed circuit board to hold the housing against the first surface of the printed circuit board, said snap fit post having a neck extending from the mounting surface and being located in an intermediate area between an edge of the housing and the terminal and an enlarged snap fit head which compresses inwardly to pass through the mounting aperture and expands outwardly after passing beyond the second surface of the printed circuit board for snug engagement against the second surface surrounding the mounting aperture to thereby capture and hold the connector to the printed circuit board.

2. The electrical connector of claim 1 wherein the housing includes side surfaces extending from the mounting surface and generally enclosing the electrical contact, an access aperture located in one of the side surfaces which defines with the mounting surface said edge of the housing and aligned to allow the external electrical source to be connected through the access aperture to the electrical contact, and the snap-fit post being off-center and located closer to said one side surface containing the access aperture.

3. The electrical connector of claim 1 wherein the snap fit post has an end portion insertable into an aperture on the printed circuit board and a canted surface spaced between the end portion and the mounting surface for snug engagement with the printed circuit board.

4. The electrical connector of claim 3 wherein the canted surface is a canted shoulder which provides an interference fit with the aperture in the printed circuit board.

5. The electrical connector of claim 1 wherein the snap-fit post has at least one slot through the snap fit post to form at least two fingers that may be compressed together.

6. The electrical connector of claim 5 wherein each finger has a tapered end portion.

7. The electrical connector of claim 1 including at least two alignment posts and at least two terminals and the alignment posts and terminals extend substantially the same distance from the mounting surface to end in a plane substantially parallel to the mounting surface, and said snap fit post extends further from the mounting surface than the alignment posts and the terminals to project beyond said plane.

8. The electrical connector of claim 1 wherein the housing includes an upper surface spaced from and parallel to the mounting surface with the electrical contact being located between the upper surface and the mounting surface, and said upper surface being substantially flat and smooth to provide a pick up surface for a suction head.

9. The electrical connector of claim 1 wherein the electrical contact is formed by a generally cylindrical pin, a leaf spring located within the housing and having a movable portion to form a make and break electrical contact, and a second terminal extending from the mounting surface and electrically connected to the leaf spring.

10. The electrical connector of claim 1 wherein a single snap fit post extends from the mounting surface to form the sole extension which is engageable with the opposite side of the printed circuit board to thereby retain the connector firmly against the printed circuit board.

11. The electrical connector of claim 1 including an alignment post extending from the mounting surface and spaced from the terminal, and the neck of the snap fit post is located in an intermediate area between the terminal and the alignment post.

12. The electrical connector of claim 11 wherein the snap-fit post is off-center in said intermediate area.

13. An electrical connector mountable on a first surface of a printed circuit board having a mounting aperture extending through the board to a second surface, comprising:

an electrical contact for connection to an external electrical source;

a housing containing the electrical contact and including a mounting surface for mating engagement with the first surface of the printed circuit board;

a terminal extending from the mounting surface and electrically connected to the contact; and a snap-fit post for insertion into the mounting aperture of the printed circuit board to hold the housing against the first surface of the printed circuit board, said snap-fit post being located in an intermediate area between an edge of the housing and the terminal and having a neck extending from the mounting surface and terminating in an enlarged snap-fit head, the length of the neck being approximately the same as the distance between the first and second surfaces of the printed circuit board, the enlarged snap-fit head including a plurality of resilient fingers which compress inwardly to pass through the mounting aperture and expand outwardly after protruding beyond the second surface of the printed circuit board, each resilient finger including a canted shoulder which extends to the neck and which is engagable with the second surface surrounding the mounting aperture to create an interference fit to securely capture and hold the housing against the first surface of the printed circuit board.

14. The electrical connector of claim 13 wherein the canted shoulder of each flexible finger forms a cam seating surface which snugly engages the edge of the mounting aperture.

15. The electrical connector of claim 13 wherein the plurality of resilient fingers each have a tapered outer wall which tapers to a terminating end having a diameter less than the diameter of the mounting aperture and a center opening which allows the plurality of resilient fingers to flex inwardly in order to pass through the mounting aperture.

16. The electrical connector of claim 13 wherein the neck is located off-center and closer to a wall containing an access opening to the housing and the snap-fit post forms the sole extension which is engagable with the second side of the printed circuit board for the purpose of retaining the connector against the second surface of the printed circuit board.

* * * * *